US006089522A

United States Patent [19]

Haslem et al.

[11] Patent Number: 6,089,522

[45] Date of Patent: Jul. 18, 2000

[54] METHOD AND APPARATUS FOR SUPPORTING REINFORCEMENT MEMBERS

[75] Inventors: Dale Haslem, Canyon Lake; G. Douglas Hartzheim, Fontana; Steve Wilbur, Chino; Marty Lancial, San Bernardino, all of Calif.

[73] Assignee: Aztec Concrete Accessories, Inc., Fontana, Calif.

[21] Appl. No.: 09/165,728

[22] Filed: Oct. 2, 1998

[51] Int. Cl.[7] ..... F16M 11/32; E04C 5/16; E01C 11/16

[52] U.S. Cl. ..... 248/440; 52/677; 52/685; 52/687; 52/689; 404/136

[58] Field of Search ..... 248/370, 440.1, 248/346.03, 346.04, 163.1; 52/677–687; 404/134–136; D8/354, 380, 356, 384; D25/134; D6/349, 352, 355, 357

[56] References Cited

U.S. PATENT DOCUMENTS

| | | | |
|---|---|---|---|
| D. 334,133 | 3/1993 | Hartzheim . | |
| D. 407,569 | 4/1999 | Underbrink | D6/349 |
| 3,255,565 | 6/1966 | Menzel . | |
| 3,693,310 | 9/1972 | Middleton . | |
| 3,830,032 | 8/1974 | Robb | 52/687 |
| 3,861,326 | 1/1975 | Brown | 108/51 |
| 4,000,591 | 1/1977 | Courtois . | |
| 4,060,954 | 12/1977 | Liuzza | 52/677 |
| 4,483,119 | 11/1984 | Hernandez . | |
| 4,655,023 | 4/1987 | Yung . | |
| 4,682,461 | 7/1987 | Sizemore . | |
| 4,756,641 | 7/1988 | Hartzheim . | |
| 4,835,933 | 6/1989 | Yung | 51/685 |
| 5,107,654 | 4/1992 | Leonardis . | |
| 5,201,869 | 4/1993 | Roethel . | |
| 5,222,628 | 6/1993 | Roethel . | |
| 5,427,019 | 6/1995 | Moorman | 108/51.3 |
| 5,507,236 | 4/1996 | Bruno | 108/51.1 |
| 5,511,903 | 4/1996 | Nichole et al. | 405/43 |
| 5,555,693 | 9/1996 | Sorkin . | |
| 5,697,675 | 12/1997 | DeWitt et al. | 297/440.12 |
| 5,729,949 | 3/1998 | Hartzheim | 52/677 |

FOREIGN PATENT DOCUMENTS

| | | |
|---|---|---|
| 227969 | 5/1960 | Australia . |
| 1 186 162 | 4/1985 | Canada . |
| 575043 | 1/1946 | Sweden . |
| 1 428 675 | 5/1972 | United Kingdom . |
| 1 276 874 | 6/1972 | United Kingdom . |

OTHER PUBLICATIONS

Product brochure from Dura–Tech of Dayton, Ohio for Plaschair and Grade Plate Spacers (date unknown).

Product brochure from Composite General, Inc. of Irving, Texas for Intersectional Chair, Mesh Chair and High Chair (date unknown).

(List continued on next page.)

*Primary Examiner*—Anita M. King
*Assistant Examiner*—Michael D. Norberg
*Attorney, Agent, or Firm*—Knobbe, Martens, Olson & Bear, LLP

[57] ABSTRACT

The present invention is an improved high chair which positions and supports reinforcement members at a desired distance from a surface. The high chair has a body with a lower base portion, an upper connecting portion and an upper support surface. One or more supporting feet are preferably attached to the lower base portion to provide for secure support of the chair on a variety of surfaces, including harder surfaces such as a concrete mold or softer surfaces such as graded soil. The upper support surface includes a support structure configured to hold the reinforcement bars in a stationary position. The upper support surface also includes a plurality of holes which allows a head piece to be mounted to the chair. The head piece allows the height of the chair to be readily adjusted.

41 Claims, 13 Drawing Sheets

OTHER PUBLICATIONS

Product brochure from Lotel, Inc. of Baton Rouge, Louisiana for Mesh–Ups (date unknown).

Product brochure from Hedlund Manufacturing Co. of Red Oak, Texas for Snap–on Paving Chairs (date unknown).

Product brochure from WHC Products, Inc. of Houston, Texas for Stak Hi–Chair (date unknown).

Product brochure from International Platics, Corp. of Nicholasville, Kentucky for X High Chair, X Bar chair and Joist Chair (1991).

Product brochure from K.Y. Trading, Inc. of Los Angeles, California from Steel Spacer and Steel High Chair (date unknown).

Product brochure from Spillman of Columbus, Ohio for Plasclips, Meshclips and Plaschair (1994).

Product brochure from Art Mould Plastics. Ltd. of Ontario, Canada for Individual High Chairs and Individual Linden Chairs (date unknown).

Product brochure from Craig's Construction Specialties, Inc. of Denver, Colorado for Mesh Chairs and Bar Chairs (date unknown).

Product brochure from Seifert Abstandhalter of Schalksmuhle, Germany for Styrofix, Styrofix–Super and Styrofix–Extra (date unknown).

Product brochure from Technique for Clip Type Spacer Clips, Spacer Chair and Support Chair (date unknown).

Product Brochure from Artikel of Wuppertal, Germany for Vierbein spacer (date unknown).

Product brochure from Eclipse Plastic of Woodinville, Washington for Tower (date unknown).

Product brochure from General Technologies, Inc. of Stafford, Texas for Reinforcing Bar Supports (1997 Price List).

Product brochure from Aztec Concrete Accessories, Inc. of Fontana, California for Adjustable Screed Chair (Dec. 1, 1997).

METHOD AND APPARATUS FOR SUPPORTING REINFORCEMENT MEMBERS

BACKGROUND OF THE INVENTION

1. Field of the Invention

The present invention relates to an apparatus for positioning reinforcement members a distance from a surface and, in particular, a method and an apparatus for locating reinforcement bars a specific distance from a surface of a mold or from a graded soil surface.

2. Description of Related Art

Many types of concrete structures, such as slabs or floors, often include reinforcement bars which are used to increase the strength and integrity of the structure. The reinforcement bars are typically arranged in rows or grids within a form into which concrete is poured. The intersection of the bars in the grid are often tied together so that the bars remain in the desired position while the concrete is being poured. Spacers are conventionally used to support and position the reinforcement bars a desired distance from the concrete form. The spacers allow the reinforcement bars to be fully encased by the concrete and the spacers allow the reinforcement bars to be positioned at a generally uniform depth within the concrete structure.

A spacer that is placed on the floor of the mold or on a graded soil surface is often referred to as a high chair or bar chair. High chairs are specifically designed to hold reinforcement bars at a predetermined distance above the floor of the mold or soil surface. This allows the reinforcement bars to be positioned at a predetermined distance from the upper and lower surfaces of the concrete structure. Proper spacing of reinforcement bars from the upper and lower surfaces of the concrete structure, according to known engineering and architectural specifications, increases the strength and integrity of the structure. Additionally, proper spacing of the reinforcement bars from the outer surfaces of the concrete structure is beneficial because it helps prevent moisture from reaching the bars, which causes deterioration of the bars.

Spacers used to position reinforcement bars within a concrete form are known. For example, U.S. Pat. No. 3,255,565 issued to Menzel discloses a tubular spacer with a base portion and a top portion. The base portion supports the top portion a predetermined distance above a concrete form, and the top portion includes a pair of diametrically opposed apertures for receiving and gripping a reinforcement rod. The base portion is supported by three or four vertically extending legs which hold the base above the surface of the mold.

Another known spacer is disclosed in United Kingdom Patent No. 1,276,874 issued to Dale, et al., which consists of a tube or pipe having multiple pairs of diametrically opposed holes which are drilled or punched through the side wall of the tube. Each end of the tube is supported by four thin legs which are spaced apart by four notches or openings. The tube has a constant diameter and is constructed of a rigid, plastic material. The holes or notches allow a single bar to be positioned at a specific height, or two or more bars to be located at different heights, relative to a given surface. These bars may be positioned either parallel or perpendicular to each other. This device allows concrete to flow into the spacer only through the openings for the reinforcement bars.

Yet another known spacer for supporting concrete reinforcement rods is disclosed in Canadian Patent No. 1,186,162 issued to Hewitt, et al. The spacer has a frusto-conical or tapered tubular body with two pairs of troughs or cut-outs on both the upper and lower surfaces of the spacer. This causes the spacer to be supported by four narrow legs. This device also allows concrete to flow into the spacer only through the openings for the reinforcement bars.

Conventional spacers are often constructed at several different standard heights because reinforcement bars are frequently spaced at different heights according to the type of structure to be formed. Disadvantageously, this requires spacers of numerous different sizes be constructed. Additionally, if spacers of a non-standard height are required, the spacers must be specially constructed or conventional spacers must be modified to the desired height. Further, because large construction projects frequently require hundreds or even thousands of spacers of different heights, large storage areas of different sized spacers are required. The burden and expense of storing and transporting hundreds or thousands of known spacers of different sizes is great.

Additionally, when the rows or grids of the reinforcement bars are being positioned or when the concrete is being poured into the form, for example, construction workers frequently step on the bars and/or spacers. Conventional spacers, especially those spacers constructed from metal rods, often collapse or deform under the added weight and stress. The deformed or broken spacers must then be replaced, which is often time consuming and awkward, otherwise the reinforcement bars are incorrectly positioned within the concrete structure.

SUMMARY OF THE INVENTION

A need therefore exists for a method and apparatus for supporting reinforcement members that is adjustable in height, provides high-strength, is easy to manufacture and install, and eliminates the above-described disadvantages.

One aspect of the present invention is a high or bar chair which positions and supports reinforcement bars at a desired distance from a surface. The high chair has a body with a lower base portion, an upper connecting portion and an upper support surface. One or more supporting feet are preferably attached to the lower base portion to provide for secure support of the chair on a variety of surfaces, including harder surfaces such as a concrete mold or softer surfaces such as graded soil. The upper support surface includes one or more members configured to hold the reinforcement bars in a stationary position. The upper support surface also includes interengaging portions which enable a head piece to be mounted to the chair. The head piece advantageously allows the height of the chair to be readily adjusted. Alternatively, the head pieces can be used without being attached to the body to support the reinforcement bars at additional distances from a surface.

The high chair of the present invention allows reinforcement bars to be supported at a plurality of different heights. First, the body of the high chair can be constructed at one of several different heights. In particular, the lower base portion and the upper support surface of each chair body has generally the same height and configuration, but the height of upper connecting portion may vary. For example, the height of the lower base portion of each chair body is about 4 inches and the height of the upper connecting portion may be about 0, 2 or 4 inches. Thus, the overall height of the chair body may be 4, 6 or 8 inches.

Second, head pieces with different heights can be releasably attached to the upper support surface of the chair body to change the height of the high chair. The head pieces have an upper body portion with two pairs of opposed notches which can support the reinforcement bars at two different heights. The head pieces also have four downwardly extending legs in a standard configuration. The legs of different head pieces have different lengths so that the reinforcement bars can be supported at a desired height. Advantageously, because the upper support surface of each chair body and the head pieces have generally the same shape and configuration, head pieces of different heights can be readily attached to the chair body. Further, because head pieces and chair bodies are readily interchangeable, high chairs with different heights can be quickly and easily constructed, but the high chairs and head pieces can be used separately to support the reinforcement bars at a desired height.

The heights of the chair bodies and head pieces are preferably selected so that the high chairs can cover a wide range of heights. In particular, the body has different heights to permit coarse adjustment of the high chair and the head pieces have different sizes to allow for fine adjustment of the height of the high chair. Significantly, because the differently sized head pieces and bodies are interchangeable, this increases the flexibility of the chair because it can be used to support reinforcement bars at a plurality of different heights. This flexibility minimizes the number of differently sized chairs that must be stored and shipped, which is a significant advantage over known chairs which required a different chair for each height.

Another aspect of the present invention is a high chair with a lower base portion including one or more inwardly tapered legs and the upper connecting portion including one or more inwardly tapered arms. Preferably, the inward taper of the arms is greater than the inward taper of the legs and the arms are connected by cross members. A support structure may be attached to the cross members to position the reinforcement member in a desired location.

Yet another aspect of the present invention is a high chair with a body having an inner surface, an outer surface, a lower base portion and an upper support surface. The upper support surface includes four openings configured to receive a head piece and the body includes a plurality of corrugations. Advantageously, the corrugations increase the strength of the chair and the surface area of the chair, and the corrugations promote bonding of the chair with the concrete. Specifically, the corrugations increase the surface area of the chair. Desirably, the head piece includes a connecting portion and one or more legs configured to be attached to the body. Preferably, the connecting portion of the head piece has a first pair and a second pair of opposed notches and, more preferably, the first pair of notches has a different depth than the second pair of notches.

Still another aspect of the present invention is a high chair with a lower base portion with four inwardly angled legs separated by apertures, an upper connecting portion with four inwardly angled arms separated by apertures, and an upper support surface with four openings. The chair also includes a head piece having a connecting portion and four legs. The legs are configured to be inserted into the openings in the upper support surface. The head piece is selectably attached to the body to adjust the height of the high chair.

The high chair of the present invention has great strength and it can support a much larger load than known chairs without deforming or breaking. Specifically, the high chair is constructed of a resilient material, such as plastic for toughness and strength, and the high chair includes significant structural features, such as a tapered body, corrugations and specially shaped apertures, to increase the strength of the chair. Thus, expensive, high-strength materials are not necessary to obtain high chairs with great strength and structural integrity. In contrast, known chairs constructed from plastic or steel rods are often easily bent or deformed if too much force is applied to the chair. For example, if a construction worker used a conventional chair to support some of his or her weight, the chair often collapsed or deformed. The high chair of the present invention, on the other hand, is able to support a greater load than conventional chairs without the use of expensive, high-strength materials.

Additionally, the high chair of the present invention includes a plurality of wide openings disposed in the exterior surface of the body to allow concrete or other similar materials to flow into the interior portion of the chair. This allows the concrete or other material to completely fill the interior of the chair, and eliminates internal gaps or trapped air which decreases the strength of the structure. Further, the chairs allow the reinforcing bars to be fully encased by concrete and this helps prevent rust and deterioration of the bars.

Further aspects, features and advantages of the present invention will become apparent from the detailed description of the preferred embodiments that follows.

BRIEF DESCRIPTION OF THE DRAWINGS

The appended drawings contain figures of preferred embodiments of the improved high chair. The above-mentioned features of the high chairs, as well as other features, will be described in connection with these preferred embodiments; however, the illustrated embodiments are only intended to illustrate the invention and not to limit the invention. The drawings contain the following figures.

DETAILED DESCRIPTION OF THE PREFERRED EMBODIMENT

Figure 1:
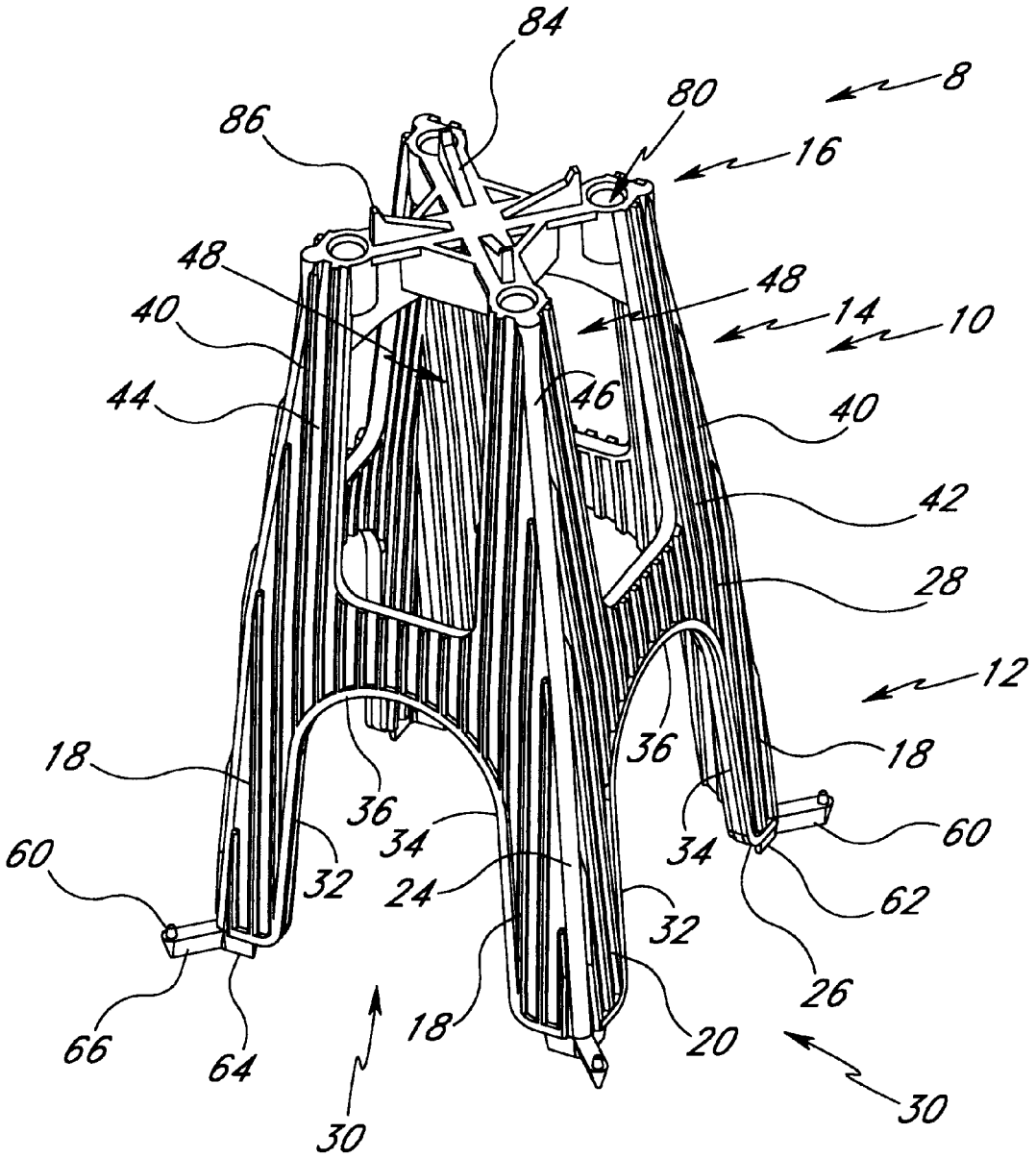
FIG. 1 is a perspective view of a portion of a high chair in accordance with a preferred embodiment of the present invention, illustrating the body of the chair.
Figure 2:
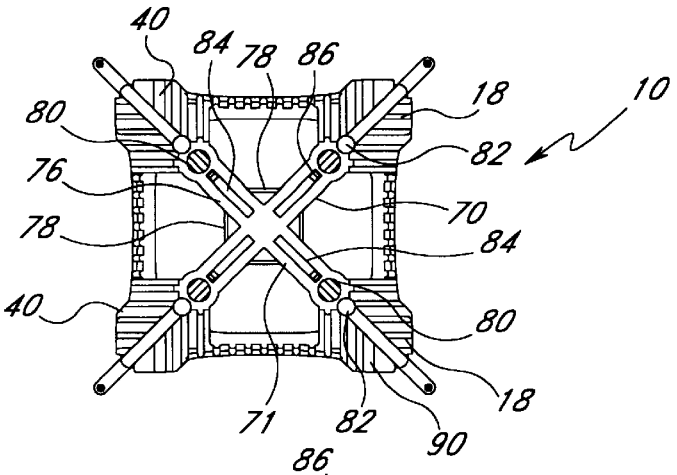
FIG. 2 is a top view of the portion of the high chair shown in FIG. 1.
Figure 3:
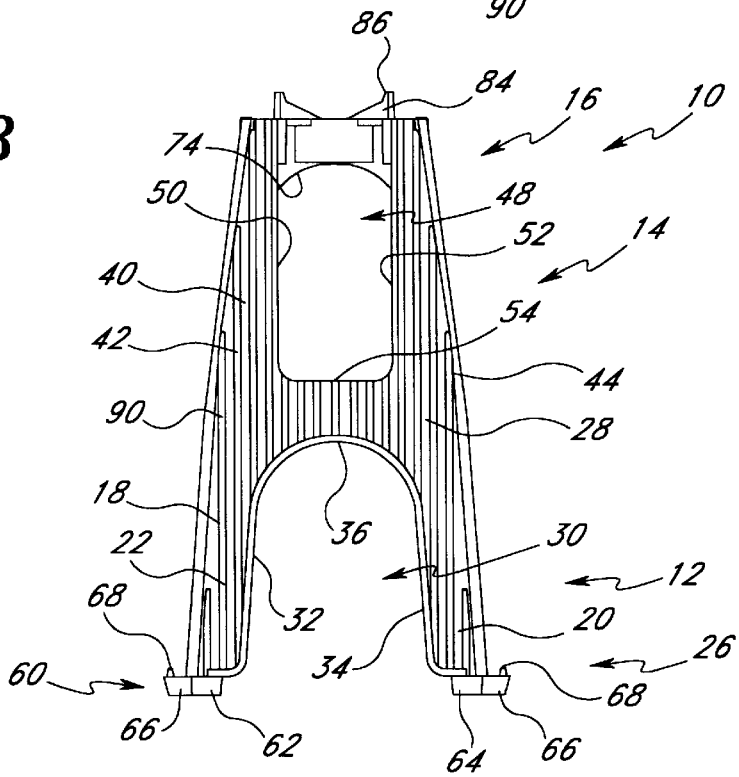
FIG. 3 is a front view of the portion of the high chair shown in FIG. 1.
Figure 4:
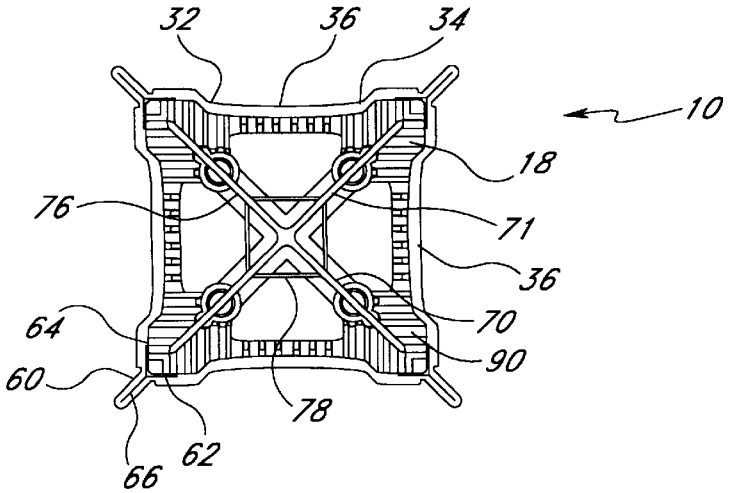
FIG. 4 is a bottom view of the portion of the high chair shown in FIG. 1.

The present invention involves an improved high or bar chair for supporting reinforcement bars a specific distance from a surface. The principles of the present invention, however, are not limited to supporting reinforcement bars and it will be understood that, in light of the present disclosure, the high chair disclosed herein can be successfully used to support pipes, tubes, conduits, beams, and other types of elongated members.

Additionally, to assist in the description of the high chair, words such as upward, downward, front and back are used to describe the accompanying figures. It will be appreciated, however, that the present invention can be located in a variety of desired positions—including various angles, sideways and even upside down. A detailed description of the present invention now follows.

FIGS. 1–5 illustrate a high chair 8 constructed according to a preferred embodiment of the present invention. The high chair 8 includes a body 10 with a lower base portion 12, an upper connecting portion 14 and an upper surface 16. The lower base portion 12 of the body 10 includes four downwardly extending legs 18 which are spaced at generally equal intervals to form the corners of a square, but the chair may have additional or fewer legs and the legs may be positioned in any desired configuration such as a rectangle, circle, pentagon, hexagon, and the like. In particular, each of the legs 18 have a first side 20 and a second side 22, and the sides intersect at surface 24 at about a right angle to form a generally V-shaped configuration. The adjacent sides 20, 22 of the four legs 18, respectively, are generally aligned in the same plane and the legs extend from the base 26 of the chair 10 toward the top of the lower base portion 12. The top of the lower base portion 12 of the chair 10 includes a continuous wall portion 28 which joins the upper portion of the legs 18, and the continuous wall portion increases the strength and structural integrity of the chair.

The legs 18 of the lower base portion 12 are tapered inwardly at an angle between about 0° and 20° and, more preferably, at an angle of about 10°, but the legs can be tapered inwardly or outwardly at any desired angle and the legs do not have to be tapered. The outer surface 24 of the four corners of the legs 18 are spaced about 4 inches apart near the base 26 of the chair and the outer surface of the legs are spaced about 3½ inches apart near the top of the upper wall portion 28. The distance from the base 26 of the chair 10 to the continuous wall portion 28 is preferably about 4 inches, but it will be appreciated that the legs can have any desired height and spacing depending, for example, upon the size and intended use of the chair 8.

Apertures 30 defined by side walls 32, 34 and arch 36 are positioned between the legs 18. The side walls 32 and 34 are preferably angled inwardly at about the same angle as the outer surface 24 of the legs 18 so that the legs have generally the same size and width. In particular, the legs 18 preferably have a width of ¾ of an inch and a thickness between about ⅛ and ¼ of an inch, but the legs can have any desired width and thickness. The side walls 32 and 34 of the aperture 30 are separated by a distance of about 2½ inches at the base 26 of the chair body 10 and about 2 inches near the base of the arch 36. The arch 36, which has a height of about ¾ of an inch, according to known engineering principles, is used to increase the strength of the chair body 10. It will be readily appreciated by one of ordinary skill in the art that any number of apertures 30 can be located between the legs 18 and the apertures may have any desired size or configuration, such as trapezoidal or triangular shaped. The apertures, however, are preferably sized at least large enough to allow the concrete or other material to flow into at least a portion of the interior of the chair to increase the strength of the structure.

The shape of the apertures 30 are designed to maximize the size of the apertures while providing legs 18 of sufficient size as not to compromise the strength of the chair body 10. The large apertures 30 maximize the free flow of concrete or other similar material into and around the chair body 10, which reduces the possibility of fracture plane formation. The legs 18 provide the ability to support larger and heavy bars, and to withstand the force when the bars and chairs are stepped-on by workers during the construction process. One of ordinary skill in the art will recognize that a variety of sizes, shapes and number of apertures can be implemented. For instance, there can be more but smaller apertures than those illustrated in the figures, and the apertures can be circles, ovals, polygons and the like.

The upper connecting portion 14 of the chair 10 connects the lower base portion 12 to the upper surface 16. The upper connecting portion 14 includes four arms 40 which are generally vertically aligned with the legs 18 and in the configuration of a square, but the connecting portion may include any number of arms in any desired configuration. Each of the arms 40 include a first side 42 and a second side 44 which intersect at a surface 46. The sides 42, 44 of each arm 40 are aligned in a generally V-shaped configuration and the adjacent sides 42, 44 of the four arms, respectively, are generally aligned in the same plane. Located between the arms 40 are apertures 48 which allow the concrete or other materials to flow into the interior portion of the chair 10. The apertures 48 have a generally U-shaped configuration with generally parallel, upwardly extending side walls 50, 52 and a generally horizontal lower surface 54. The side walls 50, 52 are generally spaced about 1½ inches apart and, as described below, the arms 40 of the chair 10 are angled inwardly.

Attached to the lower surface of each of the legs 18 of the lower base portion 12 is a foot 60. Each foot 60 includes a first portion 62 and a second portion 64 which are generally aligned with the legs 18 and joined at about a 90° angle. The first and second portions 62, 64 are about ⅜ of an inch in length, but they can be longer or shorter, and each foot 60 is about ¼ inch in height. Radially outwardly extending from the intersection of the first portion 62 and second portion 64 is a support member 66. The support member 66 is preferably about ½ of an inch in length and the member is preferably at an angle of about 135° with respect to the first and second portions 62 and 64. The first and second portions 62, 64 and member 66 are desirably tapered from an upper surface with a width of about 3/16 of an inch to a lower surface with a width of about 1/16 inch. Advantageously, the feet 60 have a minimal footprint which assists in hiding the chair body 10 from view and that improves the aesthetics of the structure. It will be appreciated, however, that the feet 60 can have any desired configuration and that the chair body 10 does not require the feet.

The feet 60 are desirably sized to support the high chair 8 on a variety of different surfaces. For example, the feet 60 may sink into or be embedded into soft surfaces such as dirt or sand to increase the stability of the chair. Additionally, the feet 60 may include an upwardly extending projection 68 located towards the distal end of the radially outwardly extending support member 66. The support member 66 and projection 68 advantageously allow the chair 8 to be fastened to a support surface such as a concrete mold, for example, to secure the chair in a fixed location. For example, a staple, wire or other type of flexible member may be used to tie or attach the foot to the mold. Additionally, the feet 60 may be attached to a support structure such as a plate to support the chair 8 in soft or expansive soil conditions. The support structure advantageously prevents the feet 60 and chair 8 from sinking into the soft soil and that allows the chair to be positioned at the desired height.

The legs 18, continuous wall portion 28 and arms 40, as well as other components of the chair body 10, generally include rounded corners to decrease stress points which may be formed in the concrete structure. Further, the rounded comers increase the strength and structural integrity of the chair. These features, along with other features disclosed herein and apparent to those skilled in the art, allow the high chair 8 to withstand much greater loads and stresses than known chairs. For example, the chairs 8 can easily support individual reinforcement members or a grid of reinforcement members. Further, the chairs 8 may allow construction workers or others to step on the grid of reinforcement members or use the grid to support various items without breaking or deforming.

The body 10 of the high chair 8 is preferably constructed as a unitary, single component which includes the legs 18, continuous wall portion 28 and arms 40. The unitary body 10 provides a high-strength chair 8, but the body may also be constructed from various components which are fastened together by any known means.

The chairs 8 are preferably constructed from a durable, weatherproof material such as plastic which advantageously does not degrade, rust or decompose. The chairs 8 are more preferably constructed from a plastic which is temperature resistant, low cost, light weight and bonds well with concrete. Most preferably, the chairs 8 are constructed from a polycarbonate/ABS alloy, but other types of plastics such as polypropylene, polyethylene, polystyrene, glass filled polystyrene, glass filled nylon, polyvinyl chloride, and the like, and other types of plastics, resins, and polymers may be used, as well as other types of materials such as metal, wood, composites, etc. The chairs constructed from plastic arc preferably injection molded, but the chairs can be made by any known means.

The hollow body 10 and the tapered legs 18 permit stacking of the chairs 8. For instance, the upper portion of a first chair may be inserted through the lower opening in a second chair because the body does not include any inwardly or outwardly projecting members which would inhibit stacking. One of ordinary skill in the art will recognize that the chair 8 of the present invention can be formed with any number of hollow and tapered body shapes which also permit stacking. For example, the chair 8 of the present invention may include not only a tapered body 10 having a generally square horizontal cross-section, but also a conical body or a body having three or more sides with a polygonal cross-section. The chair 8 may also have an elliptical, oval or hybrid cross section, such as a rectangle with rounded corners.

Advantageously, stacking of the chairs 8 decreases the required storage space of the chairs and it facilitates shipment of the chairs. In fact, the stacked chairs can significantly reduce the shipping costs and because the chairs 8 are desirably constructed from plastic rather than metal, this further decreases the shipping costs.

The apertures 30 in the lower base portion 12 allow the chairs 8 to fit over items such as other reinforcement members. For example, reinforcement members may be formed into a first grid and supported at a height less than the height of the arch 36 of the aperture 30 in the lower base portion 12. The chair 8 may be placed over the first grid to support a second grid of reinforcement members. Thus, a dual mat of reinforcement members may be created.

The chair bodies 10 of the present invention have generally the same lower base portion 12, but the height of the upper connecting portion 14 may vary to construct chair bodies 10 of different heights. In particular, the lower base portion 12 is generally about 4 inches in height and the height of the upper connecting portion preferably varies within the range of about 0 inches to about 12 inches and, more preferably, in the range of about 0 inches to about 4 inches. Most preferably, the upper connecting portion 12 is available in heights of about 0, 2 and 4 inches which creates chair bodies 10 with an overall height of about 4, 6 and 8 inches, respectively. It will be appreciated that the lower base portion 12 and upper connecting portion 14, however, can have any desired length and the chair bodies may have any desired overall height.

Figure 6:
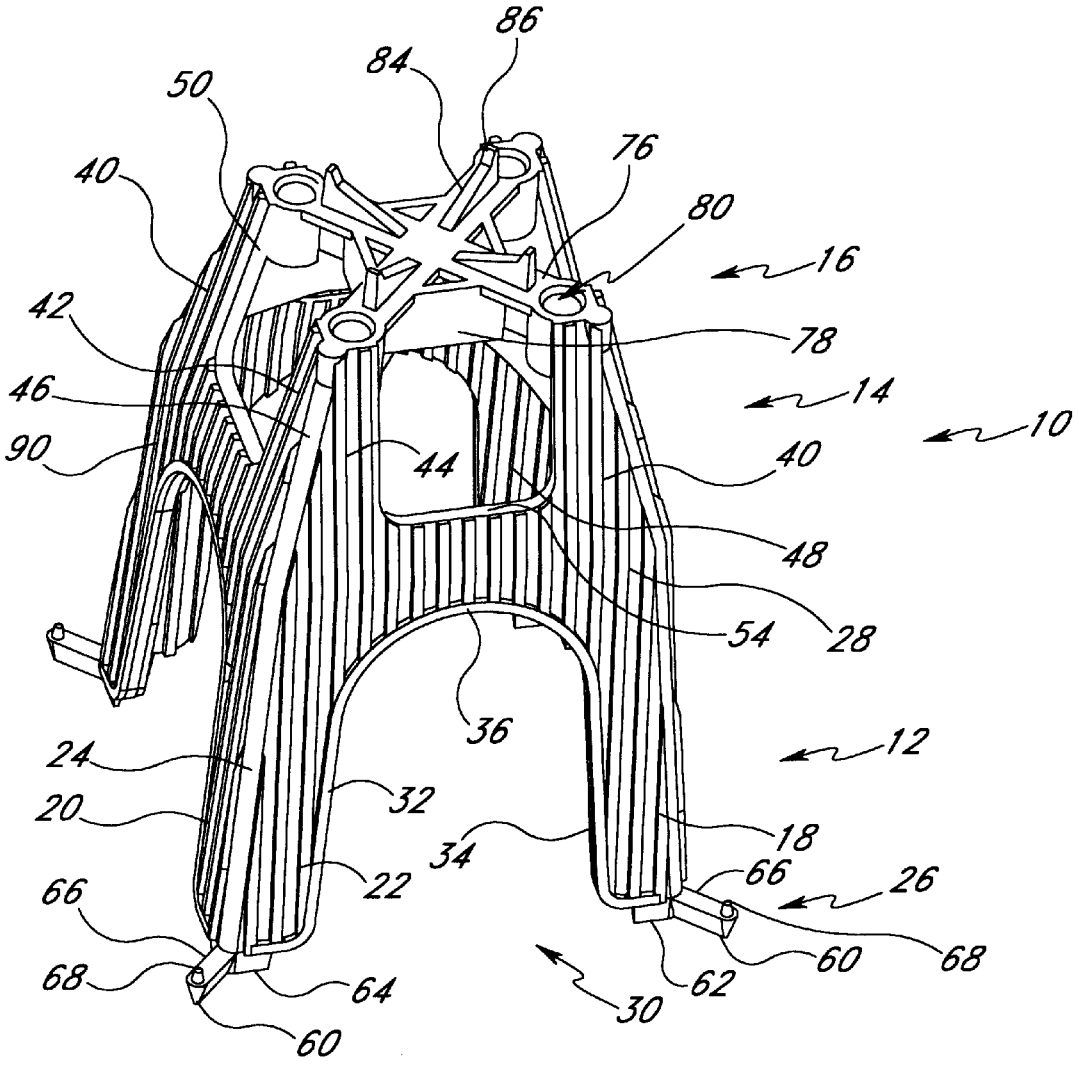
FIG. 6 is a perspective view of a portion of a high chair in accordance with another preferred embodiment of the present invention, illustrating the body of the chair.
Figure 7:
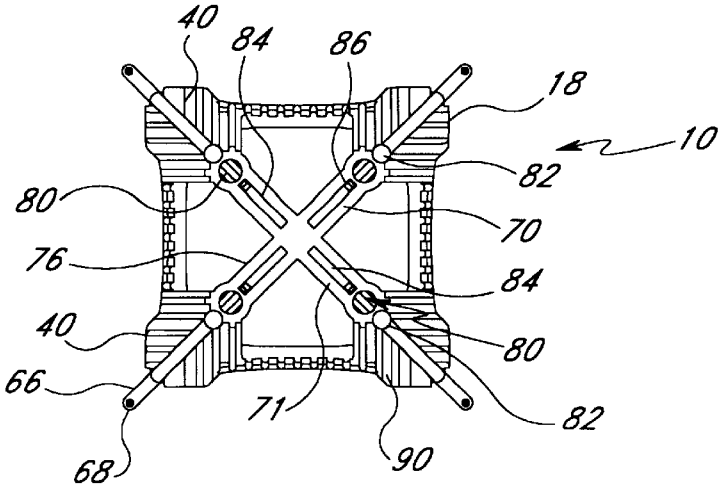
FIG. 7 is a top view of the portion of the high chair shown in FIG. 6.
Figure 8:
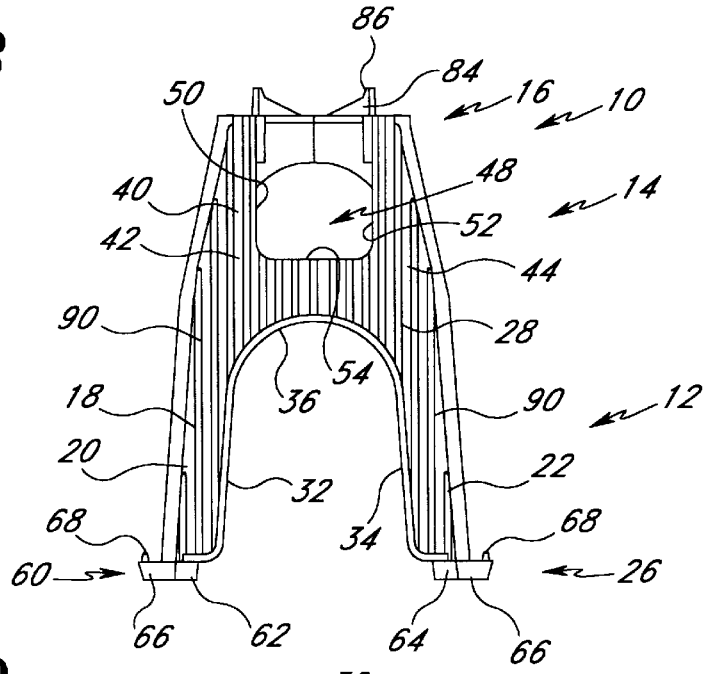
FIG. 8 is a front view of the portion of the high chair shown in FIG. 6.
Figure 9:
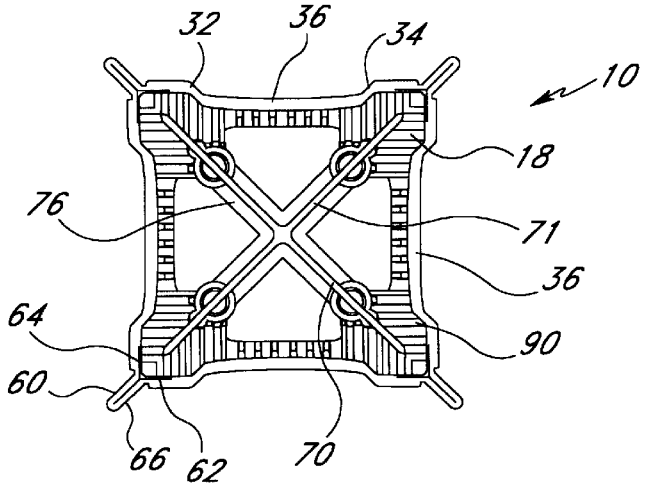
FIG. 9 is a bottom view of the portion of the high chair shown in FIG. 6.
Figure 11:
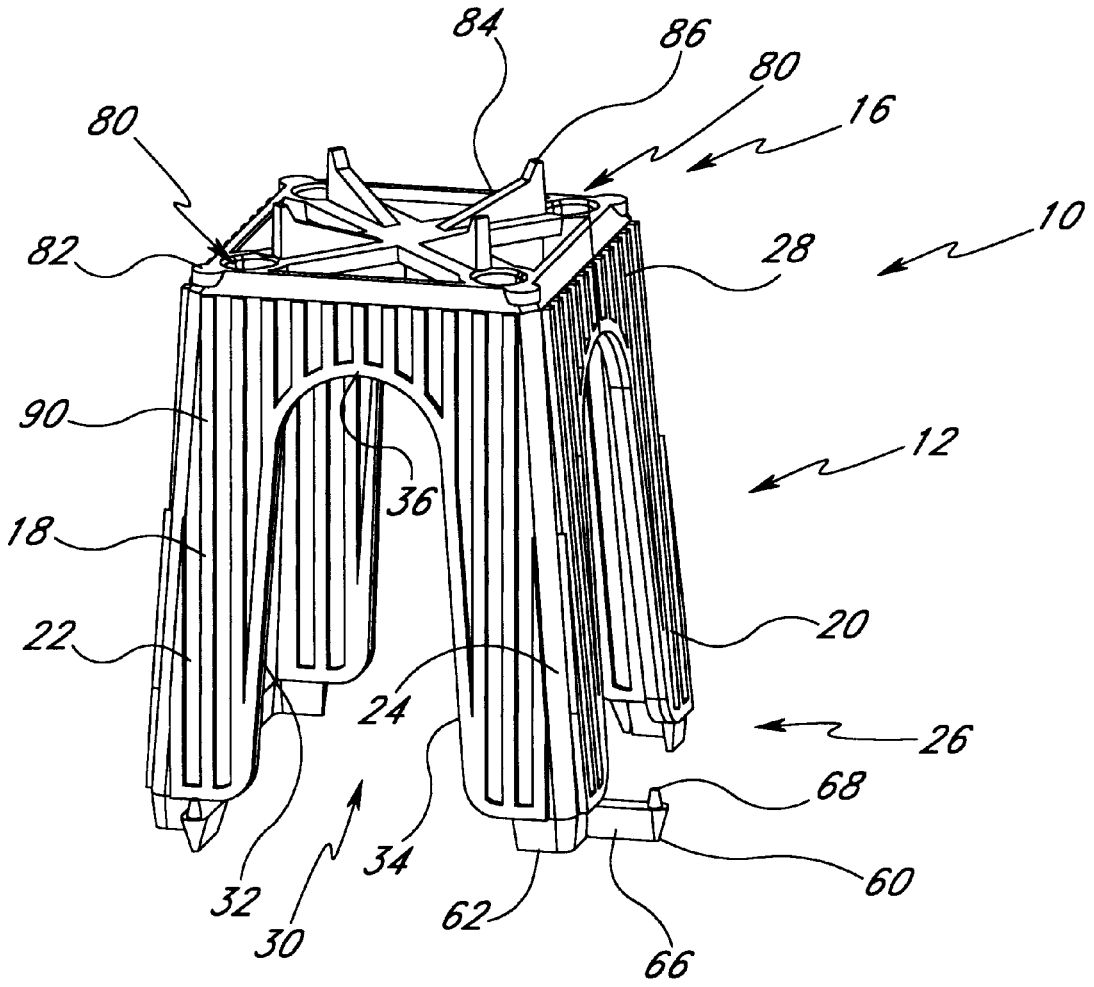
FIG. 11 is a perspective view of a portion of a high chair in accordance with yet another preferred embodiment of the present invention, illustrating the body of the chair.
Figure 12:
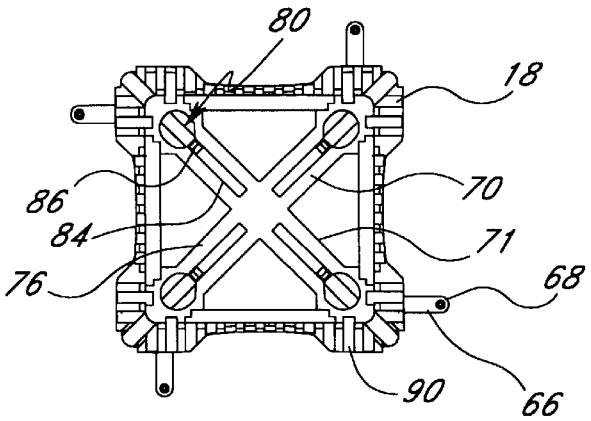
FIG. 12 is a top view of the portion of the high chair shown in FIG. 11.
Figure 13:
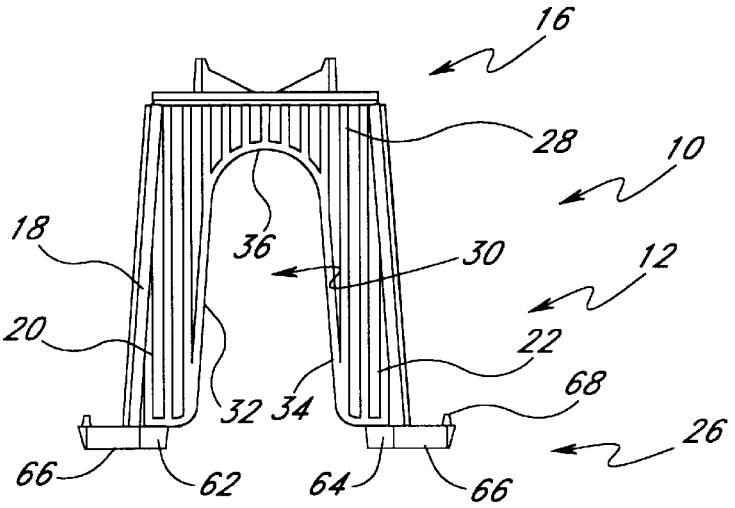
FIG. 13 is a front view of the portion of the high chair shown in FIG. 11.
Figure 14:
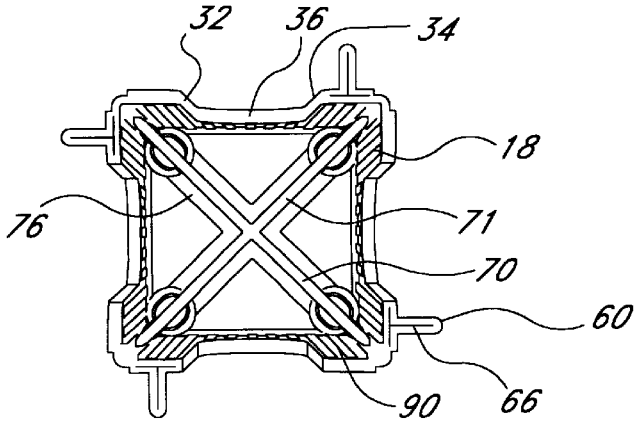
FIG. 14 is a bottom view of the portion of the high chair shown in FIG. 11.

In greater detail, as shown in FIG. 1, for example, the height of the upper connecting portion 14 is about 4 inches in length which, combined with the approximate 4 inch height of the lower base portion 12, creates a body 10 with a height of about 8 inches. As shown in FIG. 6, the upper connecting portion 14 is about 2 inches in length and this results in a body 10 with a height of about 6 inches. Additionally, as shown in FIG. 11, the upper connecting portion 14 has a height of about 0 inches and the body 10 of the chair 8 has a height of about 4 inches. Again, it will be appreciated that the upper connecting portion 14 and the lower base portion 12 can have any desired height.

The upper surface 16 of the body 10 connects the arms 40 of the upper connecting portion 14 to further increase the strength of the chair 8. In detail, the upper surface 16 includes a first cross member 70 which bisects a second cross member 71 at about a 90° angle. The cross members 70, 71 have a length of about 2¼ inches, a thickness of about ⅛ inch, and the cross members join opposing arms 40. The upper surfaces 72 of the cross members 70, 71 are located in a generally horizontal plane and the lower surfaces 74 of the cross members are preferably arched for added strength. In a preferred embodiment, the cross members 70, 71 have a height of about ½ of an inch at the intersection and a height of about 1½ inches proximate the arms 40 of the upper connecting portion 14, but it will be appreciated that the cross members 70, 71 may have any desired dimensions and/or configuration.

Attached to the upper portion of each cross member 70, 71 is a support surface 76 which extends generally the entire length of the cross member. The support surface 76 is about ⅜ inch in width and it has a thickness of about ⅛ inch, but the support surface may have any desired dimensions. Additionally, the cross members 70, 71 are connected by support gussets 78 for added strength. The support gussets 78 are about 1 inch in length, ⅛ of an inch in thickness, and about ½ of an inch in height. Preferably, four support gussets 78 with a length of about 1 inch are used in a generally square shaped configuration to connect the cross-members 70 and 71, but one skilled in the art will recognize the gussets may have various dimensions and configurations.

The upper surface 16 of the body 10 includes four downwardly extending holes 80 located at the end of each cross member 70. The holes 80, which are generally located at the corners of a square with sides about 2 inches in length, have a depth of about ⅜ of an inch and an inside diameter of about ¼ of an inch. The center of the holes 80 are separated by a diagonal distance of about 2½ inches and outwardly spaced from each of the holes 80 are end portions 82. The end portions 82 have a generally cylindrical exterior surface with an outside diameter of about ¼ of an inch and a height of about 1/16 of an inch. The end portions 82 are generally vertically aligned with the outer surface 46 of the upper connecting portion 14.

Upwardly extending from each the support surfaces 76 are inclined ramps 84 which are configured to position reinforcement bars along the upper surface of the body 10 of the chair 8. In detail, the ramps 84 have a generally triangular configuration with a base about ¾ of an inch in length and a height of about ¼ of an inch. The ramps are inclined away from the center of the body 10 and the ramps are configured to contact and abut the reinforcement bar. The ramps 84 also include an upwardly extending projection 86 to help position the reinforcement bar. One of ordinary skill in the art will also recognize that a variety of ramps 84 of different sizes and shapes can be used with the chair 8. For instance, ramps 84 which are closer together with steeper sides may more readily retain a reinforcement bar at an exact position, but this precludes the use of larger diameter bars. By contrast, larger ramps 84 which are farther apart and with more gradual slopes will accommodate both large and small diameter bars, but the bars will more readily shift position.

Reinforcement bars held in position by the ramps 84 on the upper surface 16 of the body 10 can be tied in position by inserting a wire or line through the apertures 48 in the upper connecting portion 14, passing the line underneath the upper surface 16, and tying the wire around the reinforcement bar. The line could also be passed through the apertures 30 in the lower base portion of the body 10 when tying the reinforcement bar to the upper surface 16.

The body 10 preferably includes a plurality of corrugations 90 to increase the strength and the bonding characteristics of the chair 8. The corrugations 90, for example, increase the surface area and the corrugations break up the shear plane which advantageously reduces the impact of the chair on the integrity of the concrete structure. The corrugations 90 have a generally square cross-section with a width and thickness of about 1/16 of an inch, and the corrugations are preferably vertically aligned with about ¼ of an inch between the corrugations, but the corrugations may be larger or smaller, spaced closer or farther apart and have any desired shape such as rounded or V-shaped. The corrugations 90 advantageously increase the strength of body 10 without significantly increasing the weight of the chair 8, and the corrugations are preferably vertically aligned to assist in preventing buckling of the chair from a downward load, but the corrugations may be position at any angle or in any desired configuration. The corrugations 90 are preferably located on both the inner and outer surfaces of the body 10, but the corrugations may also be located on one side or on only a portion of the body.

Figure 5:
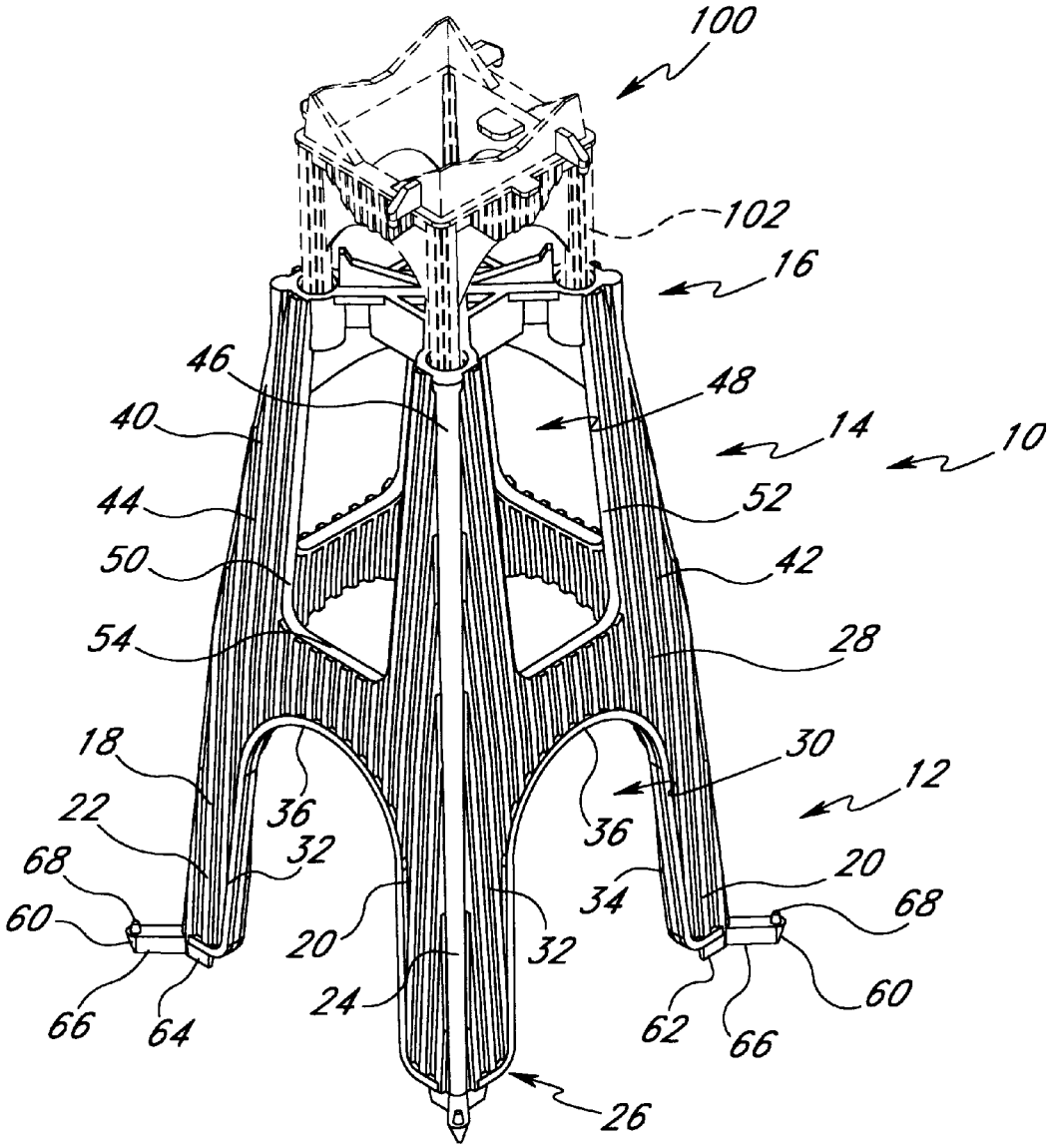
FIG. 5 is a perspective view of the portion of the high chair shown in FIG. 1, illustrating an exemplar head piece attached to the upper support surface of the high chair.
Figure 10:
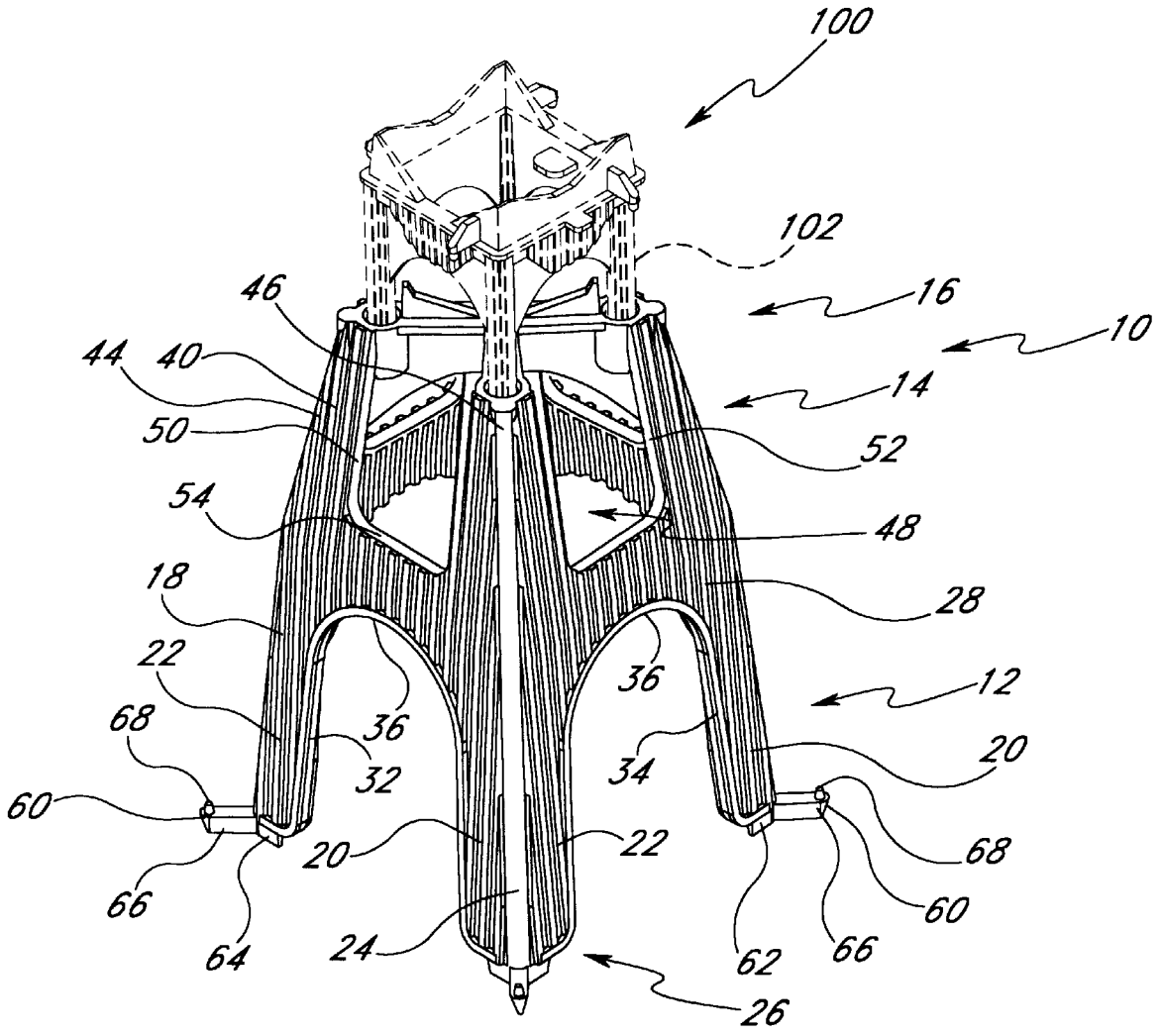
FIG. 10 is a perspective view of the portion of the high chair shown in FIG. 6, illustrating an exemplar head piece attached to the upper support surface of the high chair.
Figure 15:
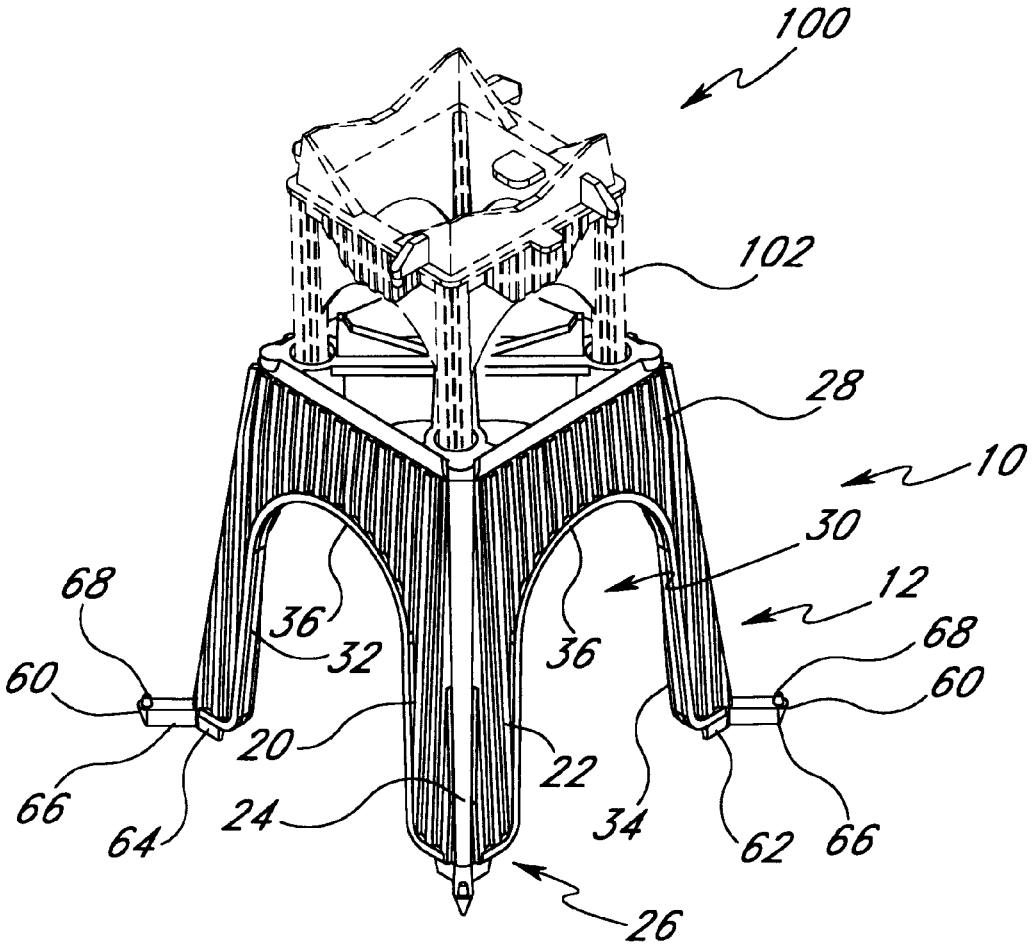
FIG. 15 is a perspective view of the portion of the high chair shown in FIG. 11, illustrating an exemplar head piece attached to the upper support surface of the high chair.
Figure 17:
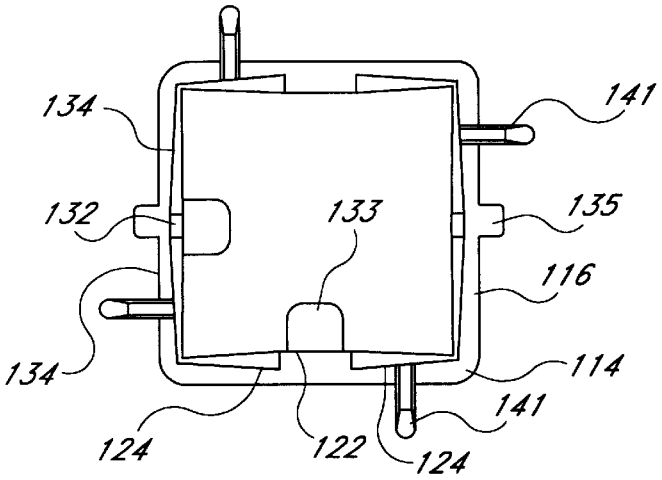
FIG. 17 is a top view of the head piece shown in FIG. 16.

As seen in FIGS. 5, 10 and 15, an exemplar head piece 100 is attached to the body 10 of the high chair 8. The head piece 100 is configured to be releasably connected to the chair body 10 and the head piece includes legs 102 which are sized and configured to be inserted into the holes 80 in the upper surface 16 of the body 10. In particular, each of the legs 102 consist of two intersecting cross members 104 which form an X-shaped configuration but the legs may have any desired shape. The cross members 104 are about ¼ of an inch in length and about ⅛ of an inch in width, and the legs 102 are arranged in the same general configuration as the holes 80 in the upper surface 16, which is a generally square configuration with the legs separated by a distance of about 1¾ inches.

A preferred embodiment of the head piece 100 is shown in FIGS. 16–19. The head piece 110 includes four downwardly extending legs 112 which are arranged in a generally square configuration with sides about 1¾ inches in length. The legs 112 are about ½ inches in length and the legs are configured to be releasably inserted into the holes 80 in the upper surface 16 of the chair 10. The legs 112 preferably have a generally X-shaped cross section with generally planar outer surfaces, but the legs may have any desired shape such as rounded or square. The legs 112 are interconnected by a connecting portion 114 which has a generally square cross section with four generally planar upper surfaces 116. The upper surfaces 116 has a width of about ¼ of an inch and a thickness of about ⅛ of an inch, but the upper surfaces may have any desired dimensions.

Figure 16:
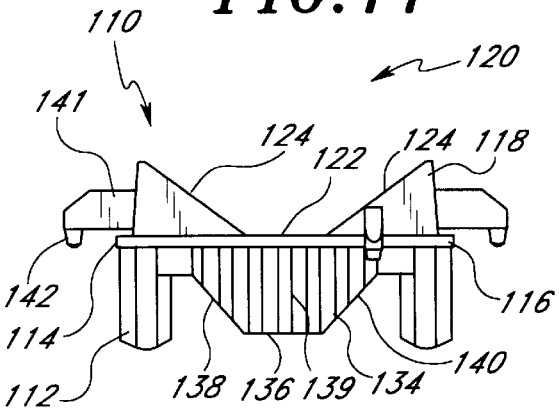
FIG. 16 is a front view of a portion of a high chair in accordance with a preferred embodiment of the present invention, illustrating a head piece.

A wall 118 with a height of about ½ of an inch is attached to the upper surfaces 116 of the head piece 110. The wall 118 includes two pairs of opposing notches which are configured to position reinforcement bars of different sizes and configurations in a desired location at a desired height. As best seen in FIG. 16, the notch 120 has a generally planar lower surface 122 and two angled outer surfaces 124. The notch 120 preferably has a depth of about ½ of an inch so that the lower surface 122 comprises a portion of the upper surface 116, but the size of the notch may be larger or smaller. The opposing notch on the other side of the head piece 110 has generally the same size and configuration as the notch 120.

Figure 19:
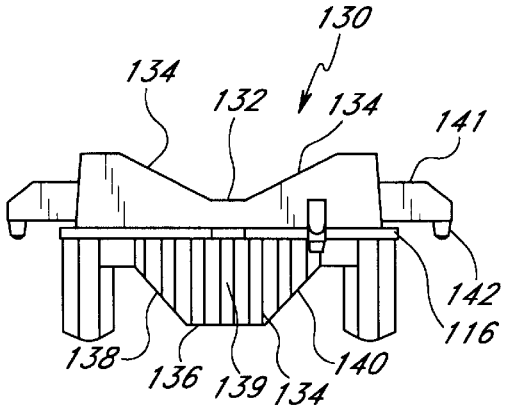
FIG. 19 is a side view of the head piece shown in FIG. 16.
Figure 18:
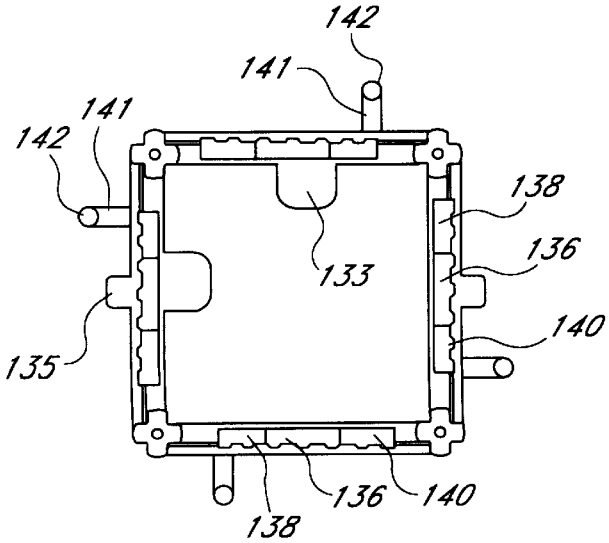
FIG. 18 is a bottom view of the head piece shown in FIG. 16.
Figure 21:
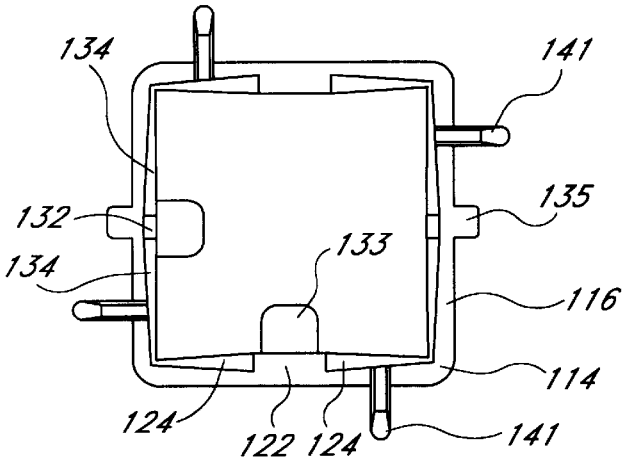
FIG. 21 is a top view of the head piece shown in FIG. 20.
Figure 20:
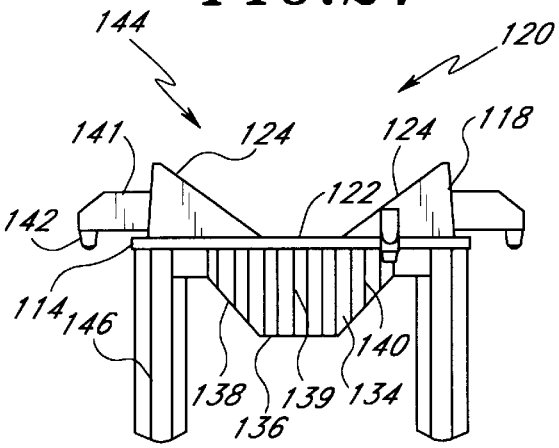
FIG. 20 is a front view of a portion of a high chair in accordance with still another preferred embodiment, illustrating a head piece.
Figure 23:
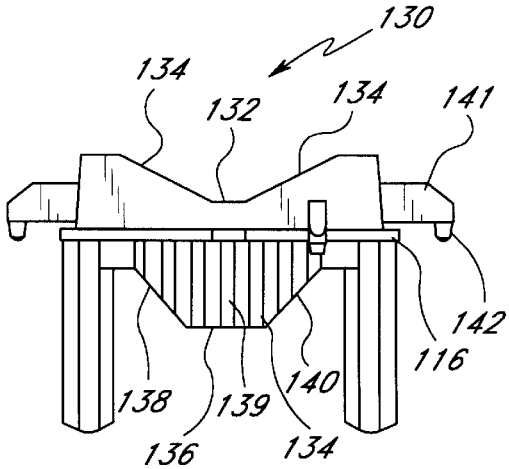
FIG. 23 is a side view of the head piece shown in FIG. 20.
Figure 22:
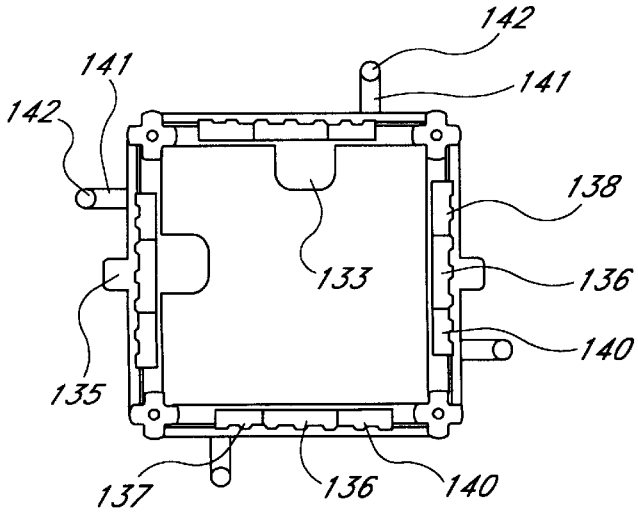
FIG. 22 is a bottom view of the head piece shown in FIG. 20.
Figure 25:
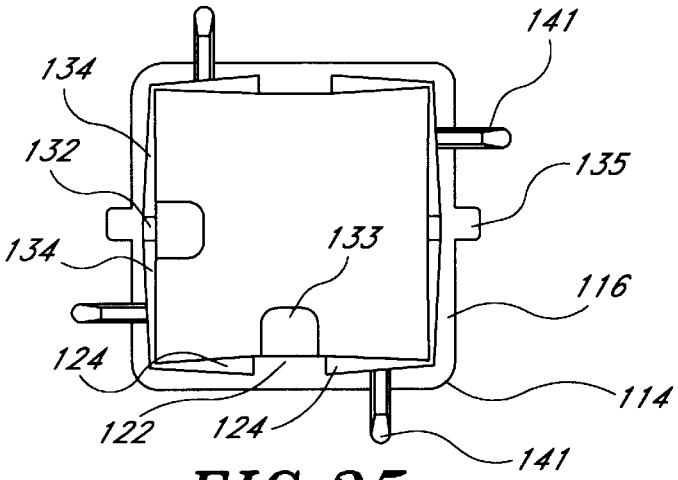
FIG. 25 is a top view of the head piece shown in FIG. 24.
Figure 24:
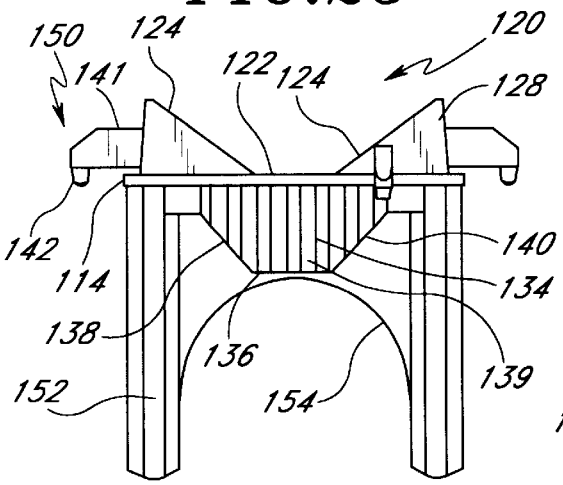
FIG. 24 is a front view of a portion of a high chair in accordance with another preferred embodiment, illustrating a head piece.
Figure 27:
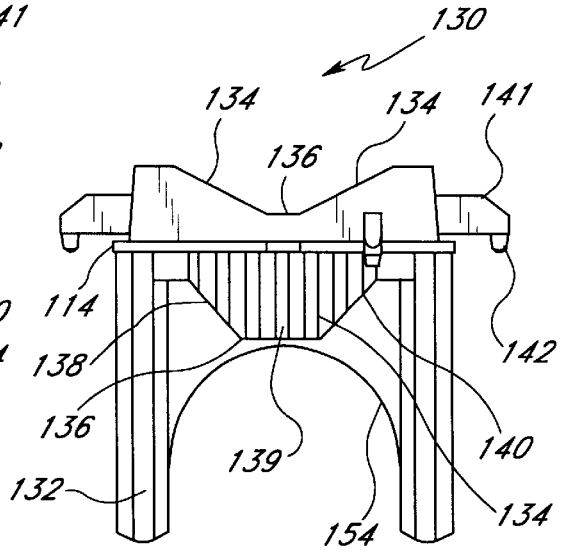
FIG. 27 is a side view of the head piece shown in FIG. 24.
Figure 26:
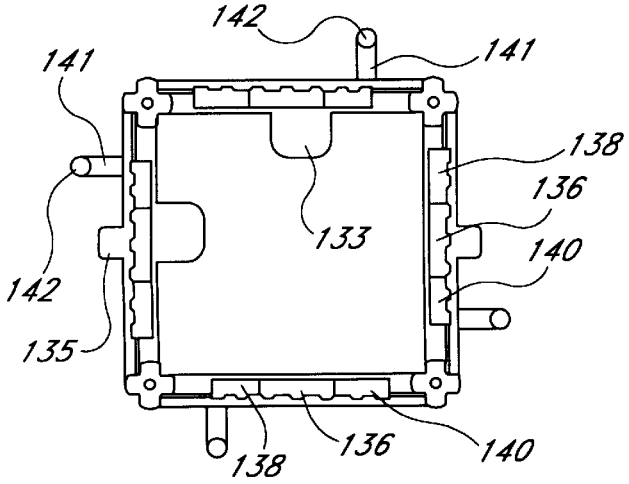
FIG. 26 is a bottom view of the head piece shown in FIG. 24.
Figure 29:
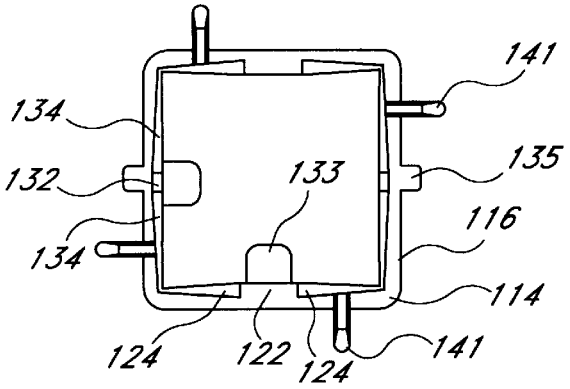
FIG. 29 is a top view of the head piece shown in FIG. 28.
Figure 28:
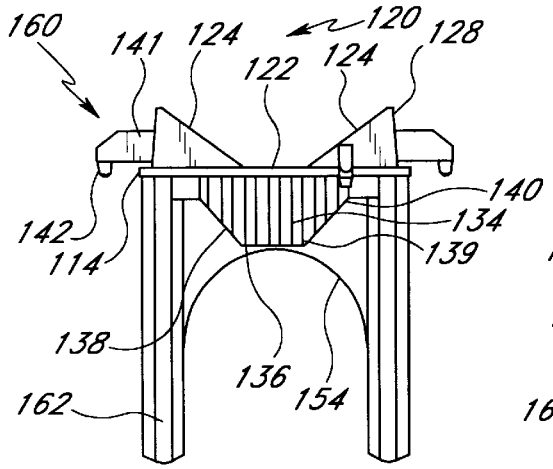
FIG. 28 is a front view of a portion of a high chair in accordance with yet another preferred embodiment, illustrating a head piece.
Figure 31:
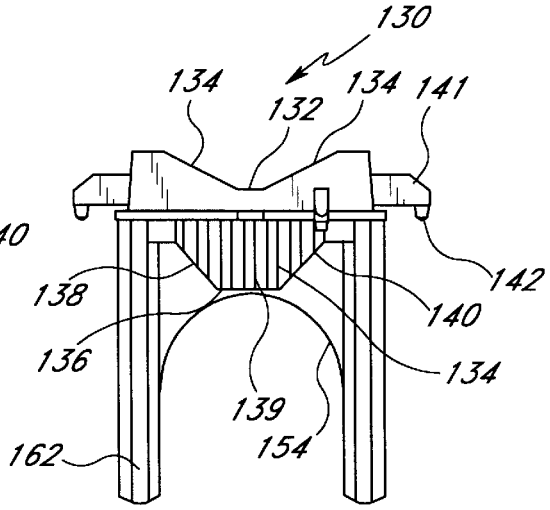
FIG. 31 is a side view of the head piece shown in FIG. 28.
Figure 30:
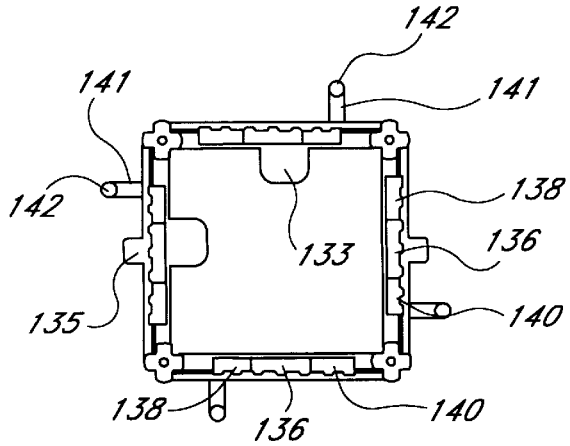
FIG. 30 is a bottom view of the head piece shown in FIG. 28.

As best seen in FIG. 19, the other aligned pair of notches 130 include a planar lower surface 132 and two angled outer surfaces 134. The lower surface 132 of the notch 130 is spaced about ¼ of an inch above the support surface 116. Thus, the height of the notches 130 are about ¼ of an inch higher than the notches 120.

The notches 120 and 130 are configured to contact and support the reinforcement bars in a desired position. Advantageously, because the notches 120 and 130 have a different depth, the reinforcement bars are supported at a different height depending upon the orientation of the head piece 110. Thus, when the head piece 110 is used with the chair body 10, the reinforcement bars can be supported at a height of about ¼ of an inch or about ½ of an inch above the upper surface 16 of the chair body 10. Thus, the height of the high chair 8 can be readily adjusted. Advantageously, when the head piece 110 is used in combination with the chair body 10, the chair 8 can be used at three distinctly different heights which increases the versatility of the chair while minimizing inventory and shipping costs. This may result in significant costs savings.

One of ordinary skill in the art will also recognize that the notches 120, 130 may have different shapes and sizes. For example, smaller notches with steeper sides may more readily retain a bar at an exact position, but preclude the use of larger diameter bars. By contrast, larger notches with sides having a more gradual slope will accommodate both large and small diameter bars, but the bars will more readily shift position. Additionally, it will be recognized a variety of other notch shapes, such as semi-circular or arc-like shapes, can be implemented. For example, notches with square sides and corners, notches which resemble inverted triangles or notches with a flexible narrow opening configured to secure the rod within the notch can be implemented. Further, it will be appreciated that the notches may have different depths and sizes.

A lower support member 134 extends downwardly from each of the upper surfaces 116 of the head piece 110. The lower support member 134 includes a generally planar base 136 with a length of about ½ of an inch and sides 138, 140 which are about ½ of an inch in length, but the support member may have any desired size or dimensions. The outer surface of the support member includes vertically extending corrugations 139 which are about 1/16 of an inch in width and separated by a distance of about ⅛ of an inch, but the corrugations may have any desired size and shape. The lower support member 134 and corrugations 139 increase the strength and structural integrity of the head piece 110.

The head piece 110 includes four outwardly extending arms 141 which are about ⅜ of an inch in length and each arm includes a downwardly extending projection 142 which is about ⅛ of an inch in length. The arms 141 allow the reinforcement bars to be tied to the head piece 110. For example, one end of a wire or line may be attached to an arm 141, the wire is then wrapped around the reinforcement bar and the other end of the wire is attached to another arm. Advantageously, the arms 141 allow the reinforcement bars to be quickly tied to the head piece 110 without requiring the line to be inserted and threaded through the apertures 30 in the lower base portion 12 or apertures 48 in the upper connecting portion of the chair body 10. This saves both time and material. Of course, the head piece 110 may include additional or fewer arms 141, the arms may be at any desired angle, and the arms could also be connected to the chair body 10.

The head piece 110 also includes one or more inwardly extending tabs 133 or outwardly extending tabs 135. The tabs 133 and 135 are desirably used to indicate the size of the head piece 110. In particular, the tabs 133 and/or 135 may include indicia which indicates the size of the head piece. For example, the indicia may include a symbol which indicates the size of the head piece or the length of the head piece can be stamped or imprinted onto the tabs. The tabs 133 and 135 can have any desired size and configuration, and the tabs can be located any where on the head piece 100. Advantageously, the tabs 133 and/or 135 can be used to show the orientation of the head piece 100 so that the head piece can be correctly positioned at the desired height. This allows the head pieces 100 to be quickly and easily positioned at the desired height, which may result in significant time and cost savings.

Another preferred embodiment of the head piece 100 is shown in FIGS. 20–23. The head piece 144 has the same general shape and configuration as the head piece 110, except the legs 146 of the head piece 144 have a length of about 1 inch. Thus, when the head piece 144 is used with the body 10, the reinforcement bars can be supported at a height of about ½ of an inch or ¾ of an inch above the upper surface 16 of the body.

Yet another preferred embodiment of the head piece 100 is shown in FIGS. 24–27. The head piece 150 has the same general shape and configuration as the head pieces 110 and 144, but the legs 152 have a length of about 1½ inches and the legs are additionally connected by an arched surface 154 to increase the structural integrity of the head piece. The arched surface 154 has a height of about ¾ of an inch and it extends from near the base 136 of the lower support member 134 to the legs 152 of the head piece 150. Still another preferred embodiment of the head piece 100 is shown in FIGS. 28–31. The head piece 160 has the same general shape and configuration as the head piece 150, but the legs 162 have a length of about 2 inches.

In sum, the legs 112, 146, 152 and 162 of the head pieces 110, 144, 150 and 160, respectively, have different lengths so that the overall height of the high chair 8 can be varied when a selected head piece is connected to the chair body 10. Desirably, because the legs of the head pieces 110, 144, 150 and 160 increase in height in about ½ inch intervals, and each of the head pieces include two pairs of opposing notches which have a difference in depth of about ¼ of an inch, the head pieces allow the height to be increased in increments of ¼ of an inch. Alternatively, the head pieces 110, 144, 150 and 160 may be used without the body 10 to support the reinforcement bars at a desired distance above a support surface. It will be appreciated that the head pieces 100 can have different configurations and legs 102 of the head pieces can be longer or shorter depending upon the desired height of the high chair.

A typical use of the present invention involves using the high chair 8 to position a reinforcement bar at a desired height. For example, a chair body 10 with a desired height is selected and a head piece 100 with a desired height is selected. The head piece 100 is then attached to the chair body 10 to create a high chair 8 of the desired height, and a reinforcement bar is placed across the upper portion of the high chair. The high chair 8 is preferably aligned such that the bar rests within either the shallow notches 132 or the deep notches 122. Thus, the height of the bar from the support surface is determined by the height of the chair body 10, the height of the head piece 100, and which pair of notches are used to position the bar. In this manner, high chairs 8 are used to set bars at a predetermined distance above the support surface. It will be understood that the high chair 8 may support only a single bar, or it may support a plurality of bars as part of a grid. Additionally, the bar may rest freely on the chair 8 or it may be retained by a separate device, such as a wire wrapped around the bar and the chair. Alternatively, a retaining device may be incorporated as an integral part of the chair, such as a combination of a toothed strap and a ratcheted catch. In such an embodiment, a bar could be placed in a notch and the toothed strap is then placed over the bar and engaged with the catch to secure the bar within the notch.

During use, groups of chair bodies and head pieces can be transported to a construction site where concrete slabs or like structures are to be formed. Selected chair bodies and head pieces can then be attached to provide a chair with a predetermined height. Alternatively, the chair bodies and head pieces can be assembled and then transported to the construction site. The chairs are then placed in the desired locations and the chairs, for example, may be attached to the form and/or the reinforcement bars may be connected to the chairs.

The present invention has been disclosed in detail in connection with the preferred embodiments, but these embodiments are disclosed by way of examples only and are not to limit the scope of the present invention, which is defined by the claims that follow. One of ordinary skill in the art will appreciate many variations and modifications within the scope of this invention.

What is claimed is:

1. A chair for supporting and spacing reinforcement members, comprising:

a substantially hollow body having a lower base portion and upper connecting portion connecting the base portion to an upper support surface, the lower base portion having a plurality of upwardly extending, inwardly tapered legs, the upper connecting portion having one or more upwardly extending, inwardly tapered arms, the inward taper of the arms being greater than the inward taper of the legs, each of said legs having a generally V-shaped cross-section with the opening of the V-shape facing the hollow interior of the body, a continuous wall portion connecting upper ends of said legs, and the portions of said legs extending below the continuous wall portion being spaced from each other, said arms having a generally V-shaped cross-section vertically aligned with said legs, with the opening to the V-shape of said arms facing the hollow interior of the body, said arms being spaced from each other by apertures beneath said upper support surface.

2. The chair of claim 1, further comprising cross members interconnecting the arms of the upper connecting portion.

3. The chair of claim 2, further comprising support members interconnecting the cross members.

4. The chair of claim 2, further comprising a support structure attached to the cross members to position a reinforcement member in a desired location.

5. The chair of claim 4, wherein the support structure includes a plurality of angled ramps configured to position the reinforcement member.

6. The chair of claim 1, wherein the upper support surface includes four openings configured to receive a head piece.

7. The chair of claim 1, further comprising a head piece, the head piece including a connecting portion and one or more legs configured to be attached to the body.

8. The chair of claim 7, further comprising a first pair and a second pair of opposed notches in the connecting portion of the head piece.

9. The chair of claim 8, wherein the first pair of notches has a different depth than the second pair of notches.

10. The chair of claim 7, further comprising one or more outwardly extending members attached to the head piece.

11. The chair of claim 1, further comprising a continuous wall portion connecting the legs of the lower base portion.

12. The chair of claim 1, wherein the arms of the upper connecting portion are separated by generally U-shaped openings.

13. The chair of claim 1, wherein the legs of the lower base portion and the arms of the upper connecting portion are generally aligned.

14. The chair of claim 1, further comprising a foot attached to a lower portion of each leg, the foot including an outwardly extending member.

15. A high chair for supporting and spacing reinforcement members, a distance above a support surface, comprising:

a body having an inner surface and an outer surface, the body including a lower base portion and an upper support surface, the lower base portion including a plurality of legs separated by apertures, the upper support surface including four openings configured to receive a headpiece; and a plurality of corrugations attached to the body to increase the strength of the high chair, said legs having a generally V-shaped cross-section with the mouth of the V-shape opening to the interior of said body, and said legs extending upwardly and tapering inwardly so that the V-shape and the taper facilitate the stacking of said chair on a similar chair.

16. The high chair of claim 15, wherein the apertures separating the legs have an arched upper surface.

17. The high chair of claim 15, wherein a lower portion of the legs have generally the same width.

18. The high chair of claim 15, further including an upper connecting portion connecting the lower base portion and the upper support surface.

19. The chair of claim 15, further comprising a head piece, the head piece including a connecting portion and one or more legs configured to be attached to the body.

20. The chair of claim 19, further comprising a first pair and a second pair of opposed notches in the connecting portion of the head piece.

21. The chair of claim 20, wherein the first pair of notches has a different depth than the second pair of notches.

22. A high chair for supporting a reinforcement member at a desired height above a surface, comprising:

a body including a lower base portion with four inwardly angled legs separated by apertures, the body including an upper connecting portion with four inwardly angled arms separated by apertures, said legs and said arms having intersecting sides creating a generally V-shaped cross-section with the mouth of the V-shapes opening inwardly to the interior of the body, a continuous wall portion connecting upper ends of said legs and being positioned between the base portion apertures and the connecting portion apertures;

a head piece having a connecting portion and four legs;

the legs and upper support surface on the body including interengaging portions which enable the headpiece to be selectably attached to the body to adjust the height of the high chair.

23. The high chair of claim 22, wherein the arms are angled inwardly at a greater angle than the inwardly angled legs.

24. The high chair of claim 22, further comprising cross members joining the four inwardly angled arms.

25. The high chair of claim 22, further comprising ramps disposed on the upper support surface to position the reinforcement member.

26. The high chair of claim 22, further comprising a first pair and a second pair of opposed notches in the head piece.

27. The high chair of claim 26, wherein each of the pairs of notches has a different depth.

28. The high chair of claim 22, further comprising a plurality of notches in the head piece.

29. The chair of claim 22, wherein the interengaging portions include four openings in the upper support surface and the legs being configured to fit within said openings.

30. A chair for supporting and spacing reinforcement members, comprising:

a substantially hollow body having a lower base portion, an upper connecting portion and an upper support surface, the lower base portion having one or more inwardly tapered legs, the upper connecting portion having one or more inwardly tapered arms, the inward taper of the arms is greater than the inward taper of the legs;

cross members interconnecting the arms of the upper connecting portion; and support members interconnecting the cross members.

31. A chair for supporting and spacing reinforcement members, comprising:

a substantially hollow body having a lower base portion, an upper connecting portion and an upper support surface, the lower base portion having one or more inwardly tapered legs, the upper connecting portion having one or more inwardly tapered arms, the inward taper of the arms is greater than the inward taper of the legs;

cross members interconnecting the arms of the upper connecting portion; and a support structure attached to the cross members to position a reinforcement member in a desired location.

32. The chair of claim 31, wherein the support structure includes a plurality of angled ramps configured to position the reinforcement member.

33. The chair of claim 32, including a head piece having a connecting portion and one or more legs configured to be attached to the body, the connecting portion of the head piece including a first pair and a second pair of opposed notches.

34. A chair for supporting and spacing reinforcement members, comprising:

a substantially hollow body having a lower base portion, an upper connecting portion and an upper support surface, the lower base portion having one or more inwardly tapered legs, the upper connecting portion having one or more inwardly tapered arms, the inward taper of the arms is greater than the inward taper of the legs;

a head piece including a connecting portion and one or more legs configured to be attached to the body, said connecting portion having a first pair and a second pair of opposed notches, with the first pair of notches having a different depth than the second pair of notches.

35. A high chair for supporting and spacing reinforcement members a distance from the support surface, comprising:

a body having an inner surface and an outer surface, the body including a lower based portion and an upper support surface, the lower base portion including a plurality of legs separated by apertures, the upper support surface including four openings configured to receive a head piece;

a plurality of corrugations attached to the body to increase the strength of the high chair; and a head piece including a connecting portion and one or more legs configured to be attached to the body, the connecting portion of the head piece having a first pair and a second pair of opposed notches.

36. The chair of claim 35, wherein the first pair of notches has a different depth than the second pair of notches.

37. A high chair for supporting a reinforcement member at a desired height above an upper support surface, comprising:

a body including a lower base portion with four inwardly angled legs separated by apertures, the body including an upper connecting portion with four inwardly angled arms separated by apertures;

a head piece having a connecting portion and four legs;

the legs and upper support surface on the body including interengaging portions which enable the head piece to be selectably attached to the body to adjust the height of the high chair; and cross members joining the four inwardly angled arms.

38. A high chair for supporting a reinforcement member at a desired height above an upper support surface, comprising:

a body including a lower base portion with four inwardly angled legs separated by apertures, the body including an upper connecting portion with four inwardly angled arms separated by apertures;

a head piece having a connecting portion and four legs;

the legs and upper support surface on the body including interengaging portions which enable the head piece to be selectably attached to the body to adjust the height of the high chair; and ramps disposed on the upper support surface to position the reinforcement member.

39. A high chair for supporting a reinforcement member at a desired height above an upper support surface, comprising:

a body including a lower base portion with four inwardly angled legs separated by apertures, the body including an upper connecting portion with four inwardly angled arms separated by apertures;

a head piece having a connecting portion and four legs;

the legs and upper support surface on the body including interengaging portions which enable the head piece to be selectably attached to the body to adjust the height of the high chair; and a first pair and a second pair of opposed notches in the head piece.

40. The high chair of claim 39, wherein each of the pairs of notches has a different depth.

41. A high chair for supporting a reinforcement member at a desired height above an upper support surface, comprising:

a body including a lower base portion with four inwardly angled legs separated by apertures, the body including an upper connecting portion with four inwardly angled arms separated by apertures;

a head piece having a connecting portion and four legs;

the legs and upper support surface on the body including interengaging portions which enable the head piece to be selectably attached to the body to adjust the height of the high chair; and a plurality of notches in the head piece.

* * * * *